US011142922B2

(12) United States Patent
Park et al.

(10) Patent No.: US 11,142,922 B2
(45) Date of Patent: Oct. 12, 2021

(54) MAISONETTE TYPE APARTMENT HOUSE DESIGN STRUCTURE FOR REDUCING NOISE BETWEEN FLOORS AND ALLOWING EASY REMODELING

(71) Applicants: Dae Yeung Park, Chungju-si (KR); Ji Yong Park, Daejeon (KR)

(72) Inventors: Dae Yeung Park, Chungju-si (KR); Ji Yong Park, Daejeon (KR)

( * ) Notice: Subject to any disclaimer, the term of this patent is extended or adjusted under 35 U.S.C. 154(b) by 0 days.

(21) Appl. No.: 17/040,797

(22) PCT Filed: Apr. 2, 2019

(86) PCT No.: PCT/KR2019/003867
§ 371 (c)(1),
(2) Date: Sep. 23, 2020

(87) PCT Pub. No.: WO2019/194532
PCT Pub. Date: Oct. 10, 2019

(65) Prior Publication Data

US 2021/0010285 A1 Jan. 14, 2021

(30) Foreign Application Priority Data

Apr. 3, 2018 (KR) ..... 10-2018-0038501

(51) Int. Cl.
*E04H 1/04* (2006.01)
*E04B 1/348* (2006.01)
(Continued)

(52) U.S. Cl.
CPC ..... *E04H 1/04* (2013.01); *E04B 1/34861* (2013.01); *E04B 1/86* (2013.01); *E04B 5/023* (2013.01); *E04C 3/30* (2013.01)

(58) Field of Classification Search
CPC ..... E04B 1/20; E04B 1/86; E04B 1/34861; E04B 2001/1993; E04B 2001/8254;
(Continued)

(56) References Cited

U.S. PATENT DOCUMENTS 268,748 A * 12/1882 Stewart ..... E04H 1/04 52/30
4,372,088 A * 2/1983 Cichos ..... E04B 1/20 52/251
(Continued)

FOREIGN PATENT DOCUMENTS

GB 570635 A * 7/1945 ..... E04B 1/20
JP 2004-225347 A 8/2004
(Continued)

*Primary Examiner* — Christine T Cajilig
(74) *Attorney, Agent, or Firm* — John K. Park; Park Law Firm

(57) ABSTRACT

The present invention relates to a design structure of an apartment house in which a plurality of apartment units, each of which is a maisonette in which two floors including an upper floor and a lower floor are combined into a single apartment unit, are repeatedly arranged in vertical and horizontal directions, wherein, in the design structure, each apartment unit has a living room disposed on the upper floor and a plurality of bedrooms disposed on the lower floor, double pillars spaced apart from each other are installed on side boundaries of adjacent apartment units, the double pillars include a pair of first pillars disposed inside an apartment unit and a pair of second pillars disposed outside the apartment unit and disposed inside another apartment unit adjacent thereto, a first beam member, which serves as a structure carrying a load, is connected to and installed at the first pillar, a second beam member, which serves as a structure carrying a load, is connected to and installed at the second pillar, and a double pillar connecting beam configured to connect the first pillar and the second pillar is
(Continued)

additionally provided on a side surface of a slab of the lower floor.

5 Claims, 5 Drawing Sheets

(51) Int. Cl.
*E04B 1/86* (2006.01)
*E04B 5/02* (2006.01)
*E04C 3/30* (2006.01)

(58) Field of Classification Search
CPC ... E04B 5/02; E04B 5/023; E04H 1/04; E04H 9/021
See application file for complete search history.

(56) References Cited

U.S. PATENT DOCUMENTS

2008/0060293 A1* 3/2008 Hanlon ..... E04B 5/04 52/251
2013/0305629 A1* 11/2013 Stephenson ..... E04B 1/3483 52/79.9
2014/0318077 A1* 10/2014 Case ..... E04B 1/74 52/843

FOREIGN PATENT DOCUMENTS

JP 2004225347 A * 8/2004
KR 10-1204767 B1 11/2012
KR 10-1387602 B1 5/2014
KR 10-1679672 B1 11/2016
KR 10-2017-0012700 A 2/2017

* cited by examiner

MAISONETTE TYPE APARTMENT HOUSE DESIGN STRUCTURE FOR REDUCING NOISE BETWEEN FLOORS AND ALLOWING EASY REMODELING

TECHNICAL FIELD

The present invention relates to a design structure of an apartment house in which each apartment unit is a maisonette and double pillars and double beams are used, and more particularly, to a maisonette-type apartment house design structure in which double pillars spaced apart from each other are installed on end portions of side boundaries between apartment units and double beams separated from each other are connected to the double pillars so that noise between floors is reduced, and a duct space is provided between the double pillars so that remodeling of the duct space may be performed easily through a lightweight wall body constructed outside.

BACKGROUND ART

As the lives of ordinary people gradually become more prosperous, houses are required not only to serve a residential purpose but also to provide a more comfortable living environment. However, residents of apartment houses such as apartments and multi-family houses, the number of which is increasing day by day, should endure inconveniences due to various kinds of noise from upper floors and there is no suitable way for the residents to satisfy their desire to freely make sounds.

Therefore, prevention of noise between floors is recognized as the first requirement of a comfortable living environment, and construction companies are also making efforts to develop materials to prevent noise between floors in order to satisfy the needs of end users.

In particular, it is common to use a wall-type structure that allows quick and convenient construction and saves construction costs for the structure of an apartment house. However, in a wall-type structure in which all structures are integrated, there is a problem in that noise and vibration are transmitted unchanged between apartment units through floors and walls.

Conventionally, it has been known that noise between floors is blocked by simply laying a sound-absorbing material thickly on a slab bottom layer. However, even when the sound-absorbing material is laid thickly on the slab bottom layer, noise due to vibration and impact from an upper floor is transmitted unchanged to a lower floor through a wall. Generally, piping is installed on a sound-absorbing layer and then finishing is performed using finishing concrete. The phenomenon in which noise is transmitted to the lower floor occurs because, when there is a beam that receives a fixed load and a moving load of the slab, the loads are transmitted from the slab to a pillar through the beam, and, in a reinforced concrete wall-type structure, no matter how thick a sound-absorbing material is laid on a bottom layer, the fixed load and moving load of a slab are directly transmitted to a lower wall body through the slab structure and thus an impact sound generated when a person on the upper floor runs or moves is transmitted unchanged to a lower apartment unit through the slab and the lower wall body connected thereto. Therefore, even when a finishing material and a sound-absorbing material are laid thickly on the bottom layer, due to the integrated slab and lower wall body which are the main noise transmission media, most of the vibration and impact from the upper floor are transmitted unchanged to a lower apartment unit and spread to the space therein. In this way, residents of apartment houses suffer from unpleasant noise.

In order to address such conventional problems, the applicant of the present invention has developed and been granted a patent on "Design structure of a maisonette-type apartment house that reduces noise between floors and includes a safe evacuation route in case of fire" (Korean Patent Registration No. 10-1679672).

However, while the impact sound transmitted to apartment units on the upper and lower floors is reduced in a case in which a single apartment unit includes two floors, a horizontal distance between apartment units becomes short and the impact sound transmitted in a horizontal direction is not changed. In order to reduce the horizontal impact sound generated when a single apartment unit includes two floors, a slab of the apartment unit should be separated from a sidewall shared with a neighboring apartment unit so that the impact sound is not transmitted in the horizontal direction. The structure for separating the slab from the sidewall may be designed in a variety of ways without major problems on middle and lower floors but has a limitation in that it may cause structural defects due to problems such as structural rigidity and seismic resistance on upper floors.

In addition, in the case of an apartment house having a wall-type structure, not only is it not possible to freely change spaces during remodeling or the like in the future, but it is also difficult to remodel pipes or the like of a duct space. The reason why remodeling is difficult is that, since an apartment house is a multi-family residence and multiple families live in separate apartment units therein, the apartment units should be remodelled collectively. Particularly, since equipment such as vertical mains and vertical ducts which are commonly used have structures that are not able to be remodelled in a common use space, the lifespan of most apartment houses is more affected by a short life of the equipment than by the life of the structure of the apartment house itself.

DISCLOSURE

Technical Problem

The objectives of the present invention which has been devised to address the above-mentioned problems are as follows.

First, the present invention is directed to providing a maisonette-type apartment house design structure in which, in an apartment house in which each apartment unit includes two floors, a living room is disposed on the upper floor and a bedroom is disposed on the lower floor so that noise between floors is reduced between upper and lower apartment units by default, and double beams and double pillars are installed at boundaries, where apartment units are adjacent horizontally, and spaced apart from each other so that noise between floors transmitted from the upper floor is reduced in a lateral direction through the structure.

Second, the present invention is also directed to providing a maisonette-type apartment house design structure in which double pillars are connected by connecting beams at every lower floor frame where apartment units are adjacent vertically so that structural safety is improved and noise between floors is reduced.

Third, the present invention is also directed to providing a maisonette-type apartment house design structure which includes a cantilever-type slab supported only by one beam member of double beams so that impact sound from the upper floor is not transmitted to adjacent apartment units to the left and right.

Fourth, the present invention is also directed to providing a maisonette-type apartment house design structure in which a duct space for equipment and facilities is provided between double pillars and a drywall body is formed outside the duct space so that easy remodeling is allowed.

Technical Solution

The technical configuration of the present invention which has been devised to achieve the above-mentioned objectives is as follows.

In a design structure of an apartment house in which a plurality of apartment units (A), each of which is a maisonette in which two floors including an upper floor (UF) and a lower floor (LF) are combined into a single apartment unit, are repeatedly arranged in vertical and horizontal directions, each apartment unit (A) has a living room (LR) disposed on the upper floor (UF) and a plurality of bedrooms (BR) disposed on the lower floor (LF), double pillars (10) spaced apart from each other are installed on side boundaries of adjacent apartment units (A), the double pillars (10) include a pair of first pillars (10*a*) disposed inside an apartment unit (A) and a pair of second pillars (10*b*) disposed outside the apartment unit (A) and disposed inside another apartment unit (A) adjacent thereto, a first beam member (20*a*), which serves as a structure carrying a load, is connected to and installed at the first pillar (10*a*), a second beam member (20*b*), which serves as a structure carrying a load, is connected to and installed at the second pillar (10*b*), a double pillar connecting beam (22) configured to connect the first pillar (10*a*) and the second pillar (10*b*) is additionally provided on a side surface of a slab of the lower floor (LF), and a cantilever slab (30), which is connected to and supported by only the first beam member (20*a*) and spaced apart from the second beam member (20*b*), is installed between the first beam member (20*a*) and the second beam member (20*b*).

Advantageous Effects

The technical effects according to the configuration of the present invention are as follows.

First, since each apartment unit has a living room disposed on the upper floor and a bedroom disposed on the lower floor, noise from the living room where heavy impact sounds are generated the most is not directly transmitted to a lower apartment unit, and thus it is possible to prevent conflicts between the upper and lower apartment units due to noise between floors.

Second, since double pillars are installed at left and right boundaries of apartment units and spaced apart from each other and double beams connected to the double pillars are also installed to be spaced apart from each other, impact sound from the upper floor is prevented from being directly transmitted to apartment units to the left and right.

In addition, since connecting beams configured to connect the double pillars spaced apart from each other are additionally installed on lower floor frames (slab portions) of the double pillars where apartment units are adjacent vertically, the impact sound transmitted from the upper floor on which the living room is disposed to the apartment units to the left and right is minimized, and structural stability can be improved.

Third, since a cantilever-type slab is formed only at one beam member of double beams which are connected to the double pillars, noise generated from a living room slab can also be blocked from being transmitted between apartment units to the left and right.

Fourth, since a duct space for mechanical equipment is formed between the double pillars and a lightweight wall body having a structure that allows easy remodeling is provided outside the duct space, the duct space can be remodelled easily without invasion of privacy.

Figure 1:
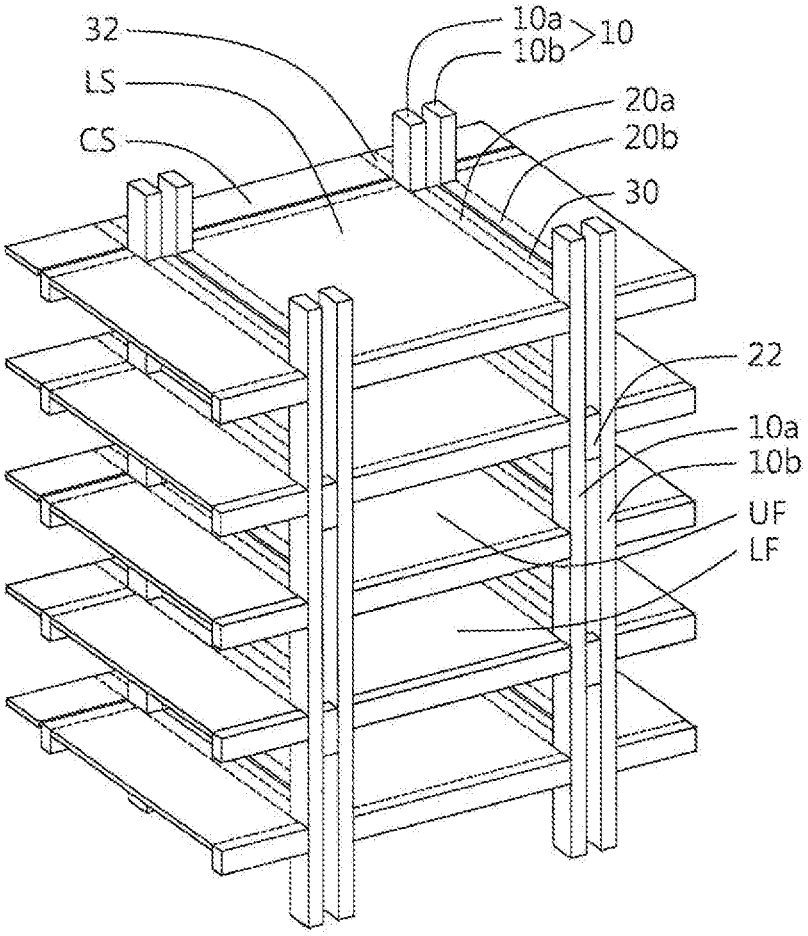
FIGS. 1 and 2 are perspective views according to a specific embodiment of the present invention.

| [Description of reference numerals] | |
|---|---|
| UF: upper floor | LF: lower floor |
| A: apartment unit | |
| LR: living room | LS: living room, slab |
| BR: bedroom | CS: corridor slab |
| 10: double pillar | |
| 10a: first pillar | 10b: second pillar |
| 20a: first beam member | 20b: second beam member |
| 22: double pillar connecting beam | |
| 30: cantilever slab | 32: cantilever beam |
| 40: duct space | 50: dry wall body |
| 60: insulating sound-absorbing plate | 70: non-bearing apartment unit boundary wall |
| 80: shear wall | |

MODES OF THE INVENTION

Hereinafter, a specific embodiment of the present invention will be described in detail with reference to the accompanying drawings.

The present invention relates to a design structure of an apartment house in which each apartment unit A includes two floors, wherein double pillars 10 and double beams are used to minimize noise between floors that is generated between apartment units which are adjacent vertically or horizontally and to improve structural performance and seismic performance and a duct space 40 is formed between the double pillars 10 so that remodeling of the duct space 40 may be performed easily.

The present invention is applied to a structure in which each apartment unit A in an apartment house is formed of two floors including an upper floor UF and a lower floor LF.

A major feature of the present invention is that, unlike in the conventional maisonette-type structure, a living room LR is disposed on the upper floor UF and a bedroom BR space is formed on the lower floor LF. Generally, heavy impact sounds which may cause inconvenience to an occupant of a lower apartment unit are mostly generated in the living room LR where children run or family members gather. In this way, the living room LR is a major source of noise in an apartment house. According to the present invention, each apartment unit A includes two floors and the living room LR is disposed on the upper floor UF so that noise and vibration including heavy impact sounds are not directly transmitted to a lower apartment unit. In other words, the bedroom BR space on the lower floor LF is utilized as a space that dampens noise and vibration generated from the living room LR on the upper floor UF, and thus the noise and vibration are not directly transmitted to the lower apartment unit.

Also, at night time while an occupant is asleep in the bedroom BR on the lower floor LF, the living room LR on the upper floor UP may be utilized as a space that dampens noise and vibration generated from an upper apartment unit. That is, on the upper floor UF of the apartment unit A, a bedroom BR space disposed on a lower floor LF of an upper apartment unit is formed. Relatively less noise is generated in the bedroom BR space than in the living room LR, and even when noise is generated in the bedroom BR of the upper apartment unit while the occupant is asleep, the living room LR on the upper floor UF of the corresponding apartment unit A serves as a noise dampening space, and thus the occupant of the bedroom BR on the lower floor LF can hardly sense the noise.

Meanwhile, when the occupant receives a warning from a lower apartment unit A due to making noise in the bedroom BR on the lower floor LF, the occupant may move a source of noise to the living room LR on the upper floor UF, and when noise is generated from the bedroom BR of the upper apartment unit, the occupant may move to the bedroom BR space on the lower floor LF to avoid the noise. In this way, conflicts between neighbors due to noise between floors may be prevented.

According to the present invention, as illustrated in FIG. 1, the double pillars 10 are installed on end portions of side boundaries between the apartment units A and spaced apart from each other.

The double pillars 10 are one of the basic frameworks that form an axial space and are vertical members that support loads on the roof, floor, beams, and the like. The double pillars 10 are installed at end portions of corners of each apartment unit A including two floors and are installed to be spaced apart from each other. The double pillars 10 include first pillars 10*a* disposed inside apartment units A and second pillars 10*b* disposed at boundaries between the apartment units A.

The first pillars 10*a* are vertical members installed inside apartment units in the plan view and cross-sectional view and are installed inside an apartment unit at one side that is disposed further inward than a boundary surface of an apartment unit A adjacent thereto. On each floor, a first beam member 20*a* is installed to connect the first pillar 10*a* with another first pillar 10*a* which is installed at a position facing the first pillar 10*a* on a horizontal boundary between the apartment units A.

The second pillars 10*b* are vertical members installed at boundaries between apartment units in the plan view and cross-sectional view and are installed to be spaced a predetermined distance from the first pillars 10*a*. Here, functional, structural, aesthetic factors and the like should be taken into consideration for the predetermined distance. Further, on each floor, a second beam member 20*b* is installed to connect the second pillar 10*b* with another second pillar 10*b* which is installed at a position facing the second pillar 10*b* on the horizontal boundary between the apartment units A.

As described above, the double pillars 10 are installed at end portions of the horizontal boundaries between the apartment units A, and the first beam members 20*a* and the second beam members 20*b* are installed to connect the double pillars 10. That is, according to the present invention, since the pillars and beams that carry loads and transmit noise due to vibration at the same time are structurally separated between the apartment units A, noise between floors may be blocked efficiently.

In addition, according to the present invention, double pillar connecting beams 22 are disposed every two floors to connect the first pillars 10*a* and the second pillars 10*b* of the double pillars 10.

The double pillar connecting beams 22 are beams installed at slab portions of the lower floors LF of the apartment units A which are adjacent vertically.

Figure 2:
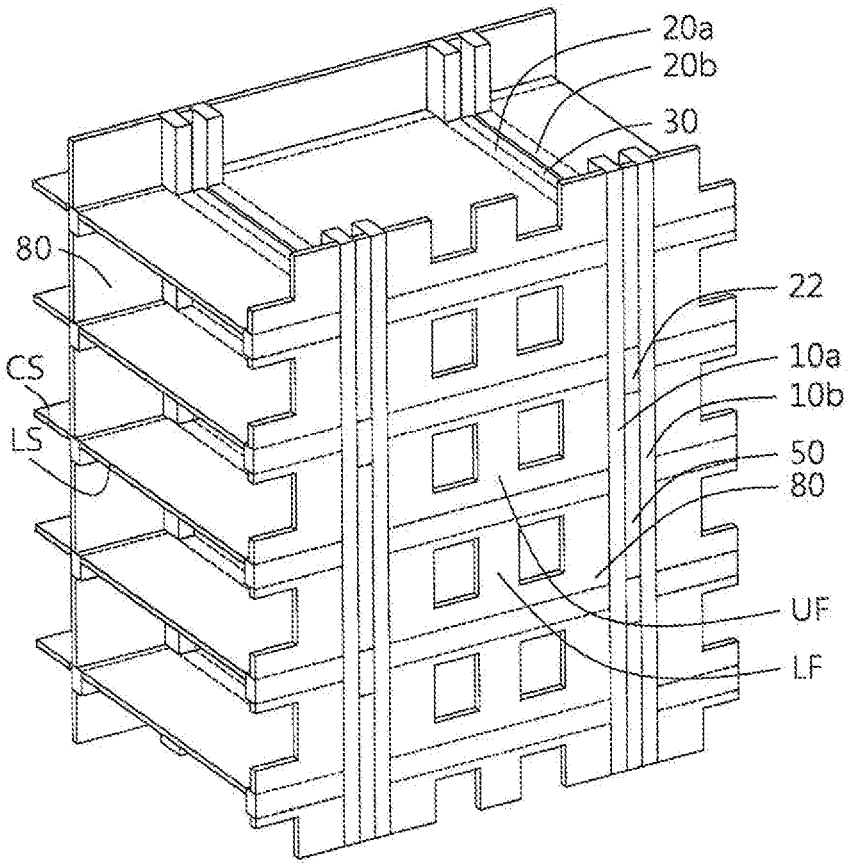

According to the present invention, as illustrated in FIGS. 1 and 2, a cantilever slab 30 which is connected to and supported by only the first beam member 20*a* and spaced apart from the second beam member 20*b* may be installed between the first beam member 20*a* and the second beam member 20*b*.

The cantilever slab 30 is installed to be supported by the first beam member 20*a* which is connected to the first pillar 10*a* installed inside an apartment unit. In this way, impact noise generated between the apartment units A is blocked from being transmitted to an adjacent apartment unit A through the slab. For example, impact noise generated from a living room slab LS of any one apartment unit may be prevented from being directly transmitted to a bedroom BR of another apartment unit A adjacent to a side surface of the living room slab LS.

Figure 3:
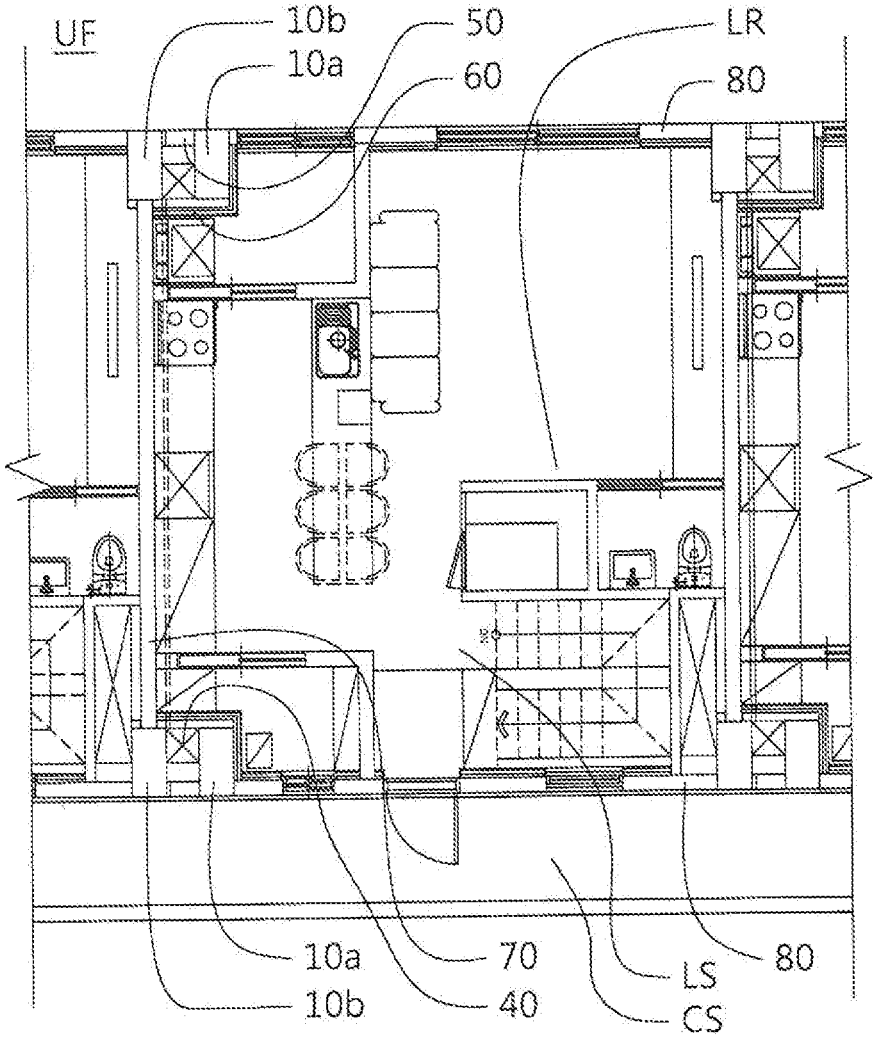
FIGS. 3 and 4 are plan views according to a specific embodiment of the present invention.
Figure 4:
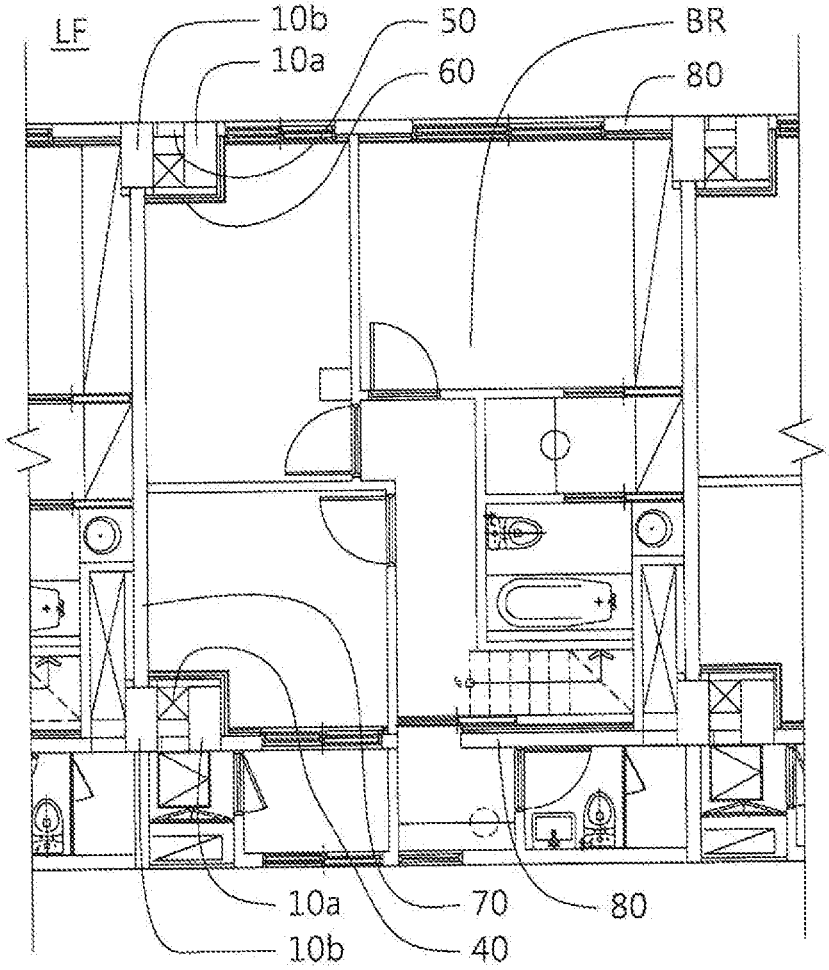

According to the present invention, as illustrated in FIGS. 3 and 4, the duct space 40 for installing machines and equipment facilities may be formed between the double pillars 10, and a drywall body 50 may be installed outside the duct space 40 and between the double pillars 10 so that an outer surface of the duct space 40 is finished. That is, the duct space 40 may be formed between the double pillars 10, and the drywall body 50, which is a type of non-bearing lightweight wall body, may be installed between the double pillars 10 in a direction toward the outside of the duct space 40.

Due to such a structure, during remodeling of the building, the equipment and machines in the building may be remodelled collectively through the drywall body 50 at an outer side surface of the building without intruding on the inside of the apartment units A.

Also, according to the present invention, a portion at which the first pillar 10*a* and the duct space 40 come in contact with the inside of the apartment unit A may have a structure that is blocked by an insulating sound-absorbing plate 60.

The insulating sound-absorbing plate 60 reduces noise transmitted to the double pillars 10 from the apartment units A adjacent thereto and noise transmitted through pipes inside the duct space 40. That is, the insulating sound-absorbing plate 60 absorbs impact sound generated from the upper floor UF that is transmitted through the pillars.

Figure 5:
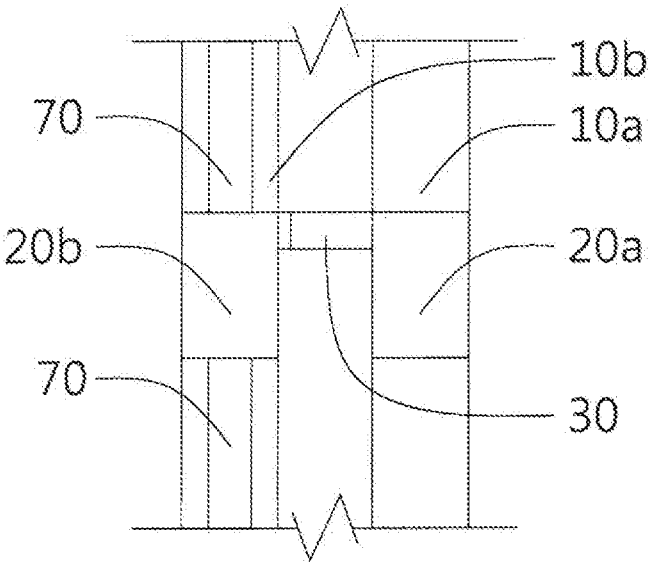
FIGS. 5 and 6 are partial cross-sectional views according to a specific embodiment of the present invention.
Figure 6:
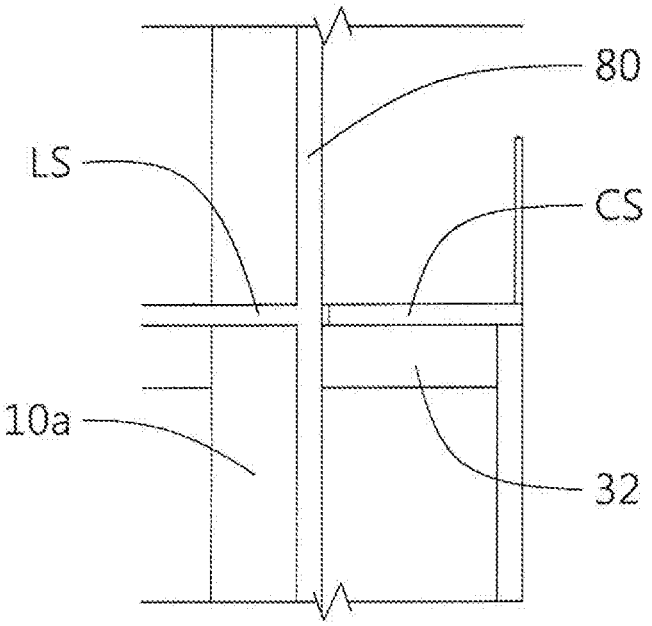

In addition, according to the present invention, as illustrated in FIGS. 5 and 6, a non-bearing apartment unit boundary wall 70 may be installed below the second beam member 20*b*, and a wall where the apartment unit A comes in contact with the outside and a corridor may be configured as a shear wall 80.

The non-bearing apartment unit boundary wall 70 is formed below the second beam member 20*b* of the double beams that is connected to the second pillar 10*b* installed at a boundary between the apartment units. That is, the non-bearing apartment unit boundary wall 70 is formed below the second beam member 20*b* of the double beams so that impact sound, which is transmitted through a wall in a conventional wall-type structure, is not transmitted through a wall. Also, for structural satisfaction, the double beams including the first beam member 20*a* and the second beam member 20*b* may be planned to have a large beam depth. In this way, since a depth of a beam or slab installed at the center of an apartment unit is smaller than the depth of the double beams, a ceiling space inside the apartment unit A may be secured sufficiently and facilities such as equipment may be easily installed without increasing the height.

Further, the shear wall 80 is installed at a boundary between the living room LR of the apartment unit A and the corridor and at a boundary between the living room LR and the outside so that structural strength is increased and seismic performance is improved. In addition, in order to improve a structural strength of the shear wall 80, openings of the upper floor UF and the lower floor LF of the apartment unit A may be formed at the same positions.

According to the present invention, the living room slab LS may be formed at an inner side of the double pillars 10, and a corridor slab CS may be formed at an outer side of the double pillars 10. The corridor slab CS may be supported by a cantilever beam 32, which is connected to an outer lower portion of the double pillars 10, and formed thereon and may be configured to be spaced apart from the living room slab LS.

In other words, the living room LR is formed at an inner side of the double pillars 10 at one side surface of an upper portion side, and the corridor is formed at an outer side thereof. The corridor slab CS is supported on the cantilever beam 32 installed to extend from the double pillars 10. In this way, since the corridor slab CS and the living room slab LS are formed to be separated, it is possible to block noise from transmitting to the inside of the apartment unit A through a wall in contact with the corridor.

The technical gist of the present invention has been described above with reference to the accompanying drawings, but the scope of the present invention is not necessarily limited to the embodiment described above. It is apparent that various design changes, addition or omission of known art, addition of simple numerical limits, and the like within the scope which does not change the technical gist of the present invention belong to the scope of the present invention.

The invention claimed is:

1. A maisonette-type apartment house design structure that reduces noise between floors and allows easy remodeling, the maisonette-type apartment house design structure being a design structure of an apartment house in which a plurality of apartment units (A), each of which is a maisonette in which two floors including an upper floor (UF) and a lower floor (LF) are combined into a single apartment unit, are repeatedly arranged in vertical and horizontal directions, wherein, in the design structure:

each apartment unit (A) has a living room (LR) disposed on the upper floor (UF) and a plurality of bedrooms (BR) disposed on the lower floor (LF), and double pillars (10) spaced apart from each other are installed on side boundaries of adjacent apartment units (A);

the double pillars (10) include a pair of first pillars (10*a*) disposed inside an apartment unit (A) and a pair of second pillars (10*b*) disposed outside the apartment unit (A) and disposed inside another apartment unit (A) adjacent thereto;

a first beam member (20*a*), which serves as a structure carrying a load, is connected to and installed at the first pillar (10*a*), and a second beam member (20*b*), which serves as a structure carrying a load, is connected to and installed at the second pillar (10*b*);

a double pillar connecting beam (22) configured to connect the first pillar (10*a*) and the second pillar (10*b*) is additionally provided on a side surface of a slab of the lower floor (LF); and a cantilever slab (30), which is connected to and supported by only the first beam member (20*a*) and spaced apart from the second beam member (20*b*), is installed between the first beam member (20*a*) and the second beam member (20*b*).

2. The maisonette-type apartment house design structure of claim 1, wherein a duct space (40) for installing a machine and an equipment facility is formed between the double pillars (10), and a drywall body (50) is installed outside the duct space (40) and between the double pillars (10) so that an outer surface of the duct space (40) is finished.

3. The maisonette-type apartment house design structure of claim 2, wherein a portion at which the first pillar (10*a*) and the duct space (40) come in contact with an inside of the apartment unit (A) is configured to be blocked by an insulating sound-absorbing plate (60).

4. The maisonette-type apartment house design structure of claim 3, wherein a non-bearing apartment unit boundary wall (70) is installed below the second beam member (20*b*), and a wall at which the apartment unit (A) comes in contact with an outside and a corridor is configured as a shear wall (80).

5. The maisonette-type apartment house design structure of claim 3, wherein a living room slab (LS) is formed at an inner side of the double pillars (10), and a corridor slab (CS) is formed at an outer side of the double pillars (10), and the corridor slab (CS) is supported by a cantilever beam (32), which is connected to an outer lower portion of the double pillars (10), and formed thereon and configured to be spaced apart from the living room slab (LS).

* * * * *